US009822479B2

(12) United States Patent
Bae et al.

(10) Patent No.: US 9,822,479 B2
(45) Date of Patent: Nov. 21, 2017

(54) CLOTHING DRYER

(71) Applicant: SAMSUNG ELECTRONICS CO., LTD., Suwon-si, Gyeonggi-do (KR)

(72) Inventors: Byeong Won Bae, Gimhae-si (KR); Sam Young Jang, Yongin-si (KR); Gyu Min Choi, Daejeon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 310 days.

(21) Appl. No.: 14/554,507

(22) Filed: Nov. 26, 2014

(65) Prior Publication Data

US 2015/0153104 A1 Jun. 4, 2015

(30) Foreign Application Priority Data

Dec. 2, 2013 (KR) ..... 10-2013-0148647

(51) Int. Cl.
*D06F 58/04* (2006.01)
*D06F 58/28* (2006.01)

(52) U.S. Cl.
CPC ..... *D06F 58/04* (2013.01); *D06F 2058/2838* (2013.01)

(58) Field of Classification Search
CPC .... D06F 58/04; D06F 2058/2838; F26B 9/00; F26B 9/003; F26B 25/18; F26B 25/185
USPC ..... 34/237, 238, 600, 239; 7/237, 238, 600; 248/685, 686, 609, 691
See application file for complete search history.

(56) References Cited

U.S. PATENT DOCUMENTS 4,895,231 A * 1/1990 Yamaguchi ..... G06F 1/1616 16/444
8,347,523 B2 * 1/2013 Chung ..... D06F 58/04 34/130
2005/0258155 A1 * 11/2005 DeYoung ..... B23K 9/32 219/130.1
2008/0209754 A1 * 9/2008 Jeong ..... D06F 58/04 34/239
2010/0088918 A1 4/2010 Chung
2011/0259788 A1 * 10/2011 Zeliff ..... G06F 1/1626 206/701

(Continued)

FOREIGN PATENT DOCUMENTS

EP 1 690 973 8/2006
KR 10-2005-0056362 6/2005

(Continued)

OTHER PUBLICATIONS

International Search Report issued Feb. 26, 2015 in corresponding International Patent Application No. PCT/KR2014/011645.

(Continued)

*Primary Examiner* — John McCormack
(74) *Attorney, Agent, or Firm* — Staas & Halsey LLP

(57) ABSTRACT

A clothing dryer including a cabinet; a drying tub that is disposed in the cabinet and accommodates laundry; a drying shelf disposed in the drying tub; and a supporting member disposed to support the drying shelf and provided to be movable at a first position in which one side of the drying shelf is supported in the cabinet and at a second position in which the supporting member is mounted on the drying shelf. Through this configuration, supporting force of the drying shelf can be improved.

17 Claims, 14 Drawing Sheets

(56) References Cited

U.S. PATENT DOCUMENTS

2012/0211453 A1* 8/2012 Stegerwald ..... A47L 15/503
211/85.3

FOREIGN PATENT DOCUMENTS

| | | |
|---|---|---|
| KR | 10-2005-0056483 | 6/2005 |
| KR | 10-2006-0030762 | 4/2006 |
| KR | 10-2010-0041032 | 4/2010 |
| WO | WO 2012/110319 | 8/2012 |

OTHER PUBLICATIONS

Chinese Office Action dated May 3, 2017 in related Chinese Application No. 201480073561.2.

* cited by examiner

CLOTHING DRYER

CROSS-REFERENCE TO RELATED APPLICATION

This application claims the benefit of Korean Patent Application No. 10-2013-0148647, filed on Dec. 2, 2013 in the Korean Intellectual Property Office, the disclosure of which is incorporated herein by reference.

BACKGROUND

1. Field

Embodiments of the present disclosure relate to a clothing dryer, and more particularly, to a clothing dryer having an improved supporting structure of a drying shelf.

2. Description of the Related Art

In general, clothing dryers are devices that dry wet laundry put into a drying tub by forcibly blowing hot air into the drying tub. These clothing dryers basically have similar appearances to those of drum washing machines and dry the laundry by forcibly circulating hot air that is heated by a heater and a blower fan into the drying tub.

A clothing dryer includes a cabinet having a front side at which a door is disposed, and the drying tub having a cylindrical shape that is lengthwise disposed in the cabinet in a forward/backward direction. Also, the clothing dryer further includes a duct that includes the heater disposed therein, converts air into hot air, guides the hot air into the drying tub, and includes the blower fan disposed therein so that the hot air discharged from the drying tub can be discharged to the outside.

The wet laundry in the drying tub becomes dry due to the dry hot air and is dried by repeated circulation of the hot air so that the laundry can be dried.

In this case, several types of clothes are tangled and extended or worn. In particular, clothes that may be easily damaged when they are dried using a dryer, or laundry that cannot be washed in the same manner as that of general laundry, such as running shoes, need to be separately dried.

SUMMARY

Therefore, it is an aspect of the present disclosure to provide a clothing dryer having an improved structure in which supporting force of a drying shelf can be improved.

Additional aspects of the disclosure will be set forth in part in the description which follows and, in part, will be apparent from the description, or may be learned by practice of the disclosure.

In accordance with one aspect of the present disclosure, a clothing dryer includes a cabinet; a drying tub that is disposed in the cabinet and accommodates laundry; a drying shelf disposed in the drying tub; and a supporting member disposed to support the drying shelf and provided to be movable at a first position in which one side of the drying shelf is supported in the cabinet and at a second position in which the supporting member is mounted on the drying shelf.

One end of the supporting member may be coupled to the drying shelf using a hinge so that the supporting member is pivoted at the first position and the second position.

The supporting member may include a pivoting portion that causes the supporting member to be pivoted at one side of the drying shelf at the first position and the second position; and a support that extends from the pivoting portion and is supported by a rear side of the drying tub.

The drying shelf may include a base on which an object to be dried is mounted; and a hanging member which is provided at one side of the base and to which the pivoting portion is coupled using a hinge.

When a lengthwise direction of the base is a first direction, the hanging member may protrude from the base in a second direction that is perpendicular to the first direction, and the supporting member may be pivoted around the second direction that is a central axis.

The drying shelf may include mounting grooves on which the supporting member at the second position is mounted; and fixing protrusions provided on the mounting grooves and fixing the supporting member.

The drying shelf may further include separation grooves that are disposed in the mounting grooves so as to pivot the supporting member at the second position and are formed to have larger widths than those of the adjacent mounting grooves.

The supporting member may further include a fixed hanging portion that is provided at an end of the support so as to be fixed to the rear side of the drying tub, and the drying tub may include a cylindrical portion that is rotatably provided; and a rear side portion having an outlet through which dry air is introduced into the drying tub and disposed at a rear side of the cylindrical portion, and the fixed hanging portion may be provided to be hung in the outlet.

The drying shelf may include a base on which an object to be dried is mounted, and when the supporting member is at the first position, the support may be provided to form an obtuse angle with the base.

The drying tub may include a cylindrical portion that is rotatably provided; and a rear side portion disposed at a rear side of the cylindrical portion, and the drying shelf may include a pair of supporting protrusions that protrude from the base so as to be supported by the rear side portion.

The supporting member may include a pivoting portion that causes the supporting member to be pivoted at one side of the drying shelf at the first position and the second position; and a support that extends from the pivoting portion and is supported by a rear side of the drying tub, and the pivoting portion may be disposed between the pair of supporting protrusions.

In accordance with another aspect of the present disclosure, a clothing dryer includes a cabinet; a drying tub that is disposed in the cabinet and accommodates laundry; a drying shelf disposed in the drying tub; and a supporting member including a pivoting portion that is pivotably provided at one side of the drying shelf and a support that extends from the pivoting portion and is supported by a rear side of the drying tub, the supporting member being disposed to support the drying shelf and provided to be pivotable at a first position in which the drying shelf is supported by the rear side of the drying tub and at a second position in which the supporting member is mounted on the drying shelf.

The drying shelf may include a base on which an object to be dried is mounted; and a hanging member which is provided at one side of the base and to which the pivoting portion is coupled using a hinge, and the pivoting portion may be coupled to the hanging member using a hinge so that the supporting member can be pivoted.

The hanging member may protrude from the base in a direction of a first axis that is a horizontal direction, and the supporting member may be pivoted around the first axis.

The supporting member may be provided so that the first position and the second position constitute an obtuse angle.

The drying shelf may further include supporting protrusions that protrude from the base toward the rear side of the drying tub so as to be supported by the rear side of the drying tub.

The supporting member may further include a fixed hanging portion that is bent from an end of the support and extends so as to be fixed to the rear side of the drying tub at the first position.

The drying shelf may further include mounting grooves formed concavely to correspond to a lengthwise direction of the supporting member so that the supporting member can be mounted on the mounting grooves; and fixing protrusions that are provided on the mounting grooves and fix sides of the support.

The fixing protrusions may include a pair of fixing protrusions that support both sides of the supporting member that is at the second position.

In accordance with still another aspect of the present disclosure, a clothing dryer includes a cabinet; a drying tub including a cylindrical portion that is rotatably provided and a rear side portion disposed at a rear side of the cylindrical portion, the drying tub being disposed in the cabinet; a drying shelf having a base on which an object to be dried is mounted and disposed in the drying tub; a main supporting member that protrudes from the base so that the drying shelf is supported by the rear side portion; and an auxiliary supporting member having one end provided to be pivoted around the drying shelf and the other end supported by the rear side portion.

The auxiliary supporting member may be provided to be pivotable at a first position in which one side of the base is supported by the rear side portion and at a second position in which the auxiliary supporting member is mounted on the drying shelf.

The auxiliary supporting member may further include a pivoting portion that is coupled to the drying shelf using a hinge so that the auxiliary supporting member can be pivoted at the first position and the second position.

The drying shelf may include mounting grooves that are formed concaver than a surface of the adjacent base so that the auxiliary supporting member at the second position can be mounted on the mounting grooves.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
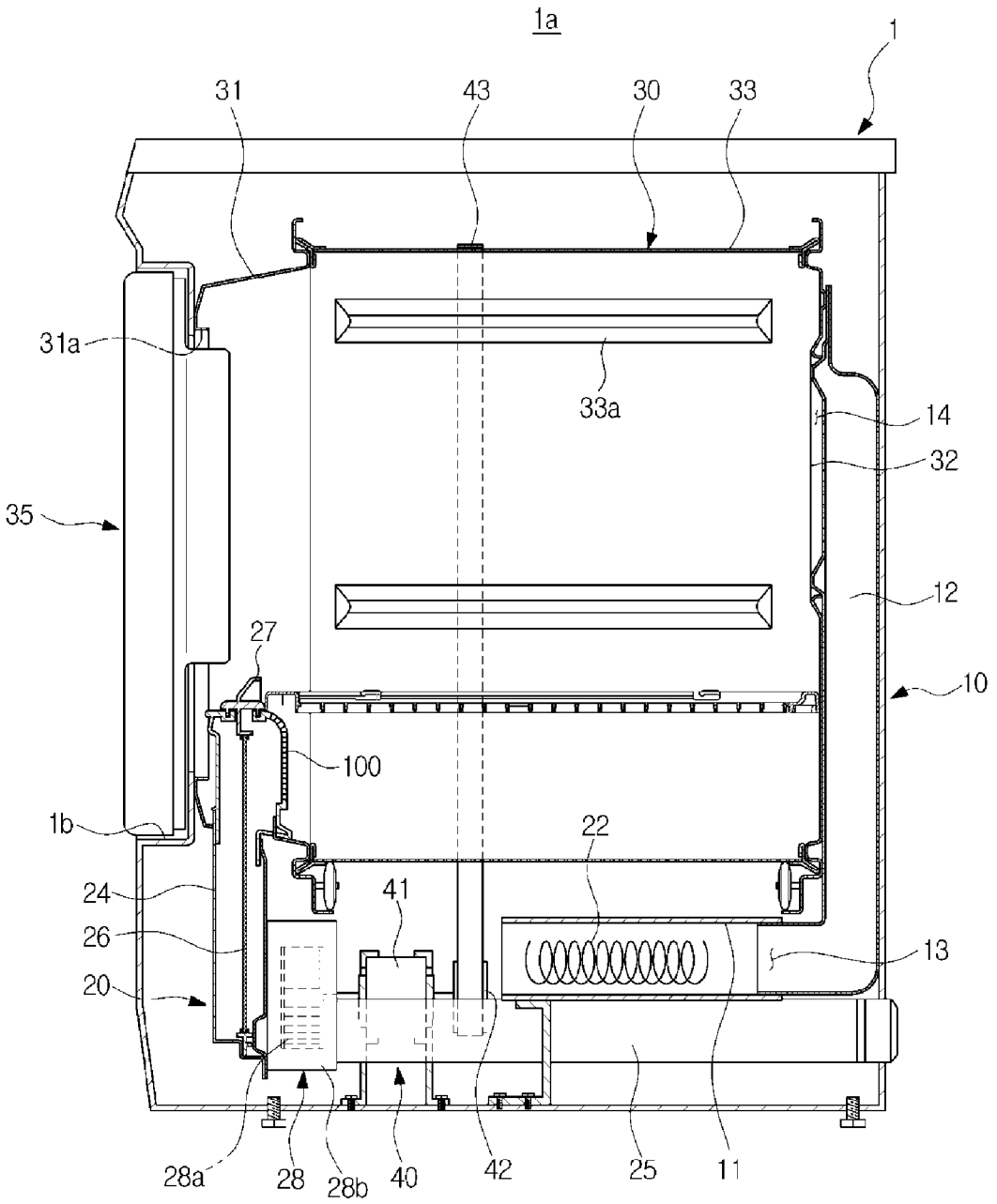
FIG. 1 is a cross-sectional view of a clothing dryer according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a clothing dryer according to an embodiment of the present disclosure.

As illustrated in FIG. 1, a clothing dryer 1*a* according to the current embodiment of the present disclosure includes a cabinet 1 that constitutes an exterior, a drying tub 30 that is rotatably installed in the cabinet 1, a driving unit 40 for rotating the drying tub 30, and an absorption flow path 10, an exhaust flow path 20, and a blower unit 28 for air circulation into the drying tub 30.

The drying tub 30 is provided to include a cylindrical portion 33 and a rear side portion 32. The cylindrical portion 33 has a cylindrical shape in which front and rear sides of the cylindrical portion 33 are opened. A front side portion 31 is coupled to the front side of the cylindrical portion 33, and the rear side portion 32 is installed at the rear side of the cylindrical portion 33.

Laundry ports 1*b* and 31*a* through which laundry may be put into or taken out from the drying tub 30, are formed at a front side of the cabinet 1 and the front side portion 31, and a door 35 that opens/closes the laundry ports 1*b* and 31*a* is installed at the front side of the cabinet 1.

The driving unit 40 includes a driving motor 41 installed at a lower part of an inner side of the cabinet 1, a pulley 42 that transfers driving force of the driving motor 41 to the drying tub 30, and a rotary belt 43. The rotary belt 43 is installed to be wound around the pulley 42 coupled to an outer surface of the drying tub 30 and a shaft of the driving motor 41.

The absorption flow path 10 guides introduction of external air into the drying tub 30. The absorption flow path 10 includes a first duct 12 having an inlet 13 through which air is absorbed from the drying tub 30 and an outlet 14 through which air is discharged to the drying tub 30. The first duct 12 may be coupled to the rear side portion 32 of the drying tub 30. Also, the absorption flow path 10 may include a heating duct 11 that is installed at a lower part of the drying tub 30 and coupled to the first duct 12. A heater 22 is installed in the heating duct 11 so as to heat absorbed air.

The exhaust flow path 20 guides discharge of air introduced into the drying tub 30. The exhaust flow path 20 includes a front duct 24 that connects an inlet of a filter member 100 at a lower part of the front side portion 31 and an inlet of the blower unit 28 installed at a lower part of the drying tub 30, and a second duct 25 that is installed at a lower side of the cabinet 1 so that an outlet of the blower unit 28 and an outer side of a rear side of the cabinet 1 communicate with each other.

The blower unit 28 includes a blower unit housing 28*b* and a blower fan 28*a* disposed inside the blower unit housing 28*b*. As the blower fan 28*a* operates, humid air inside the drying tub 30 may be discharged or moved in a direction of the heater 22.

An internal filter member 26 is installed at the front duct 24 so as to filter foreign substances, such as dust or lint included in hot air discharged from the drying tub 30. A handle portion 27 through which a user may easily detach the internal filter member 26 from the front duct 24 by applying force, may be disposed at an upper side of the internal filter member 26.

The filter member 100 may be disposed around the internal filter member 26 so as to guide air absorbed into the internal filter member 26.

Figure 2:
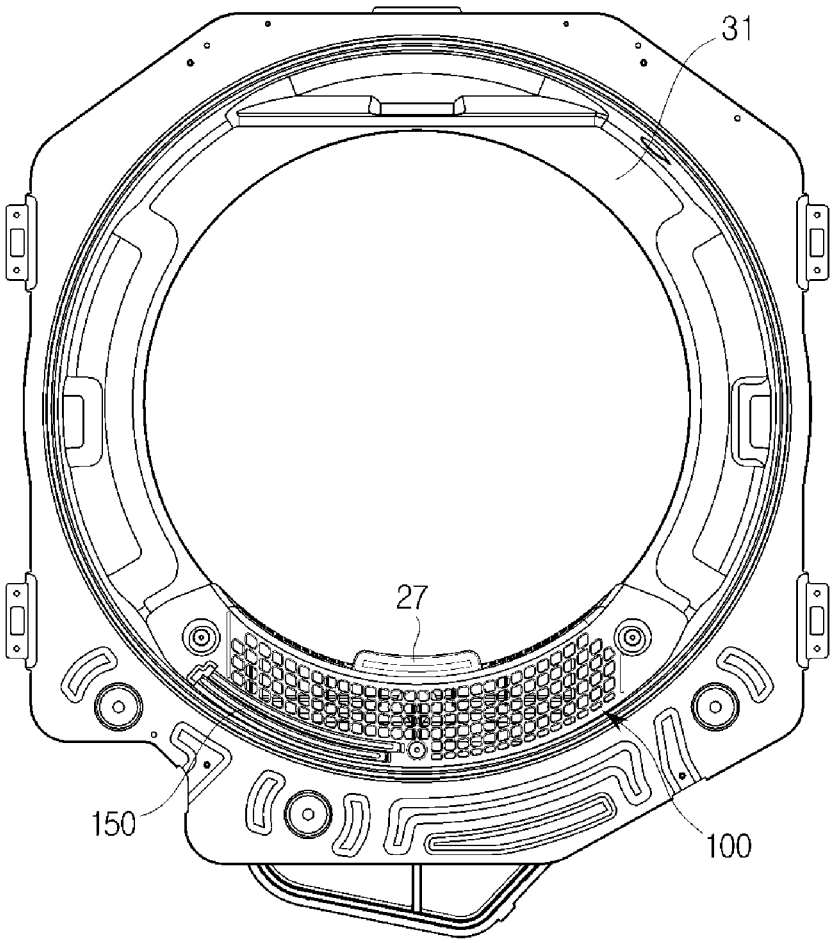
FIG. 2 is a view illustrating a front side of the clothing dryer illustrated in FIG. 1.
Figure 3:
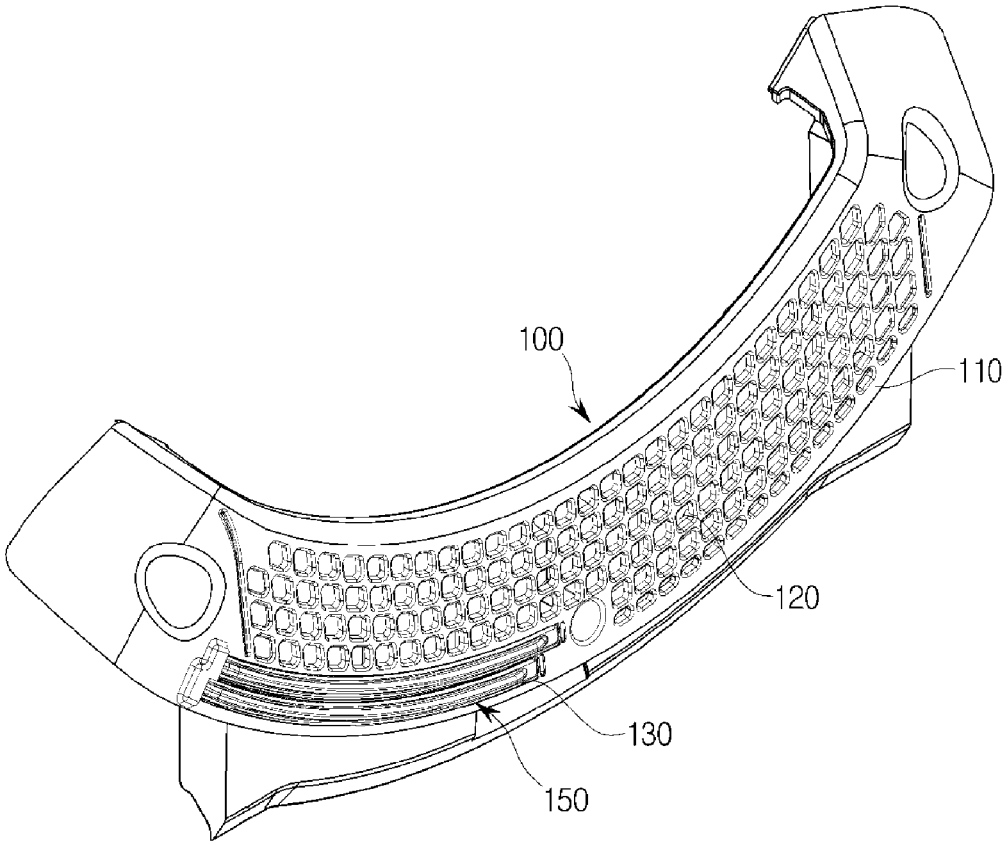
FIG. 3 is a view illustrating a filter member according to an embodiment of the present disclosure.
Figure 4:
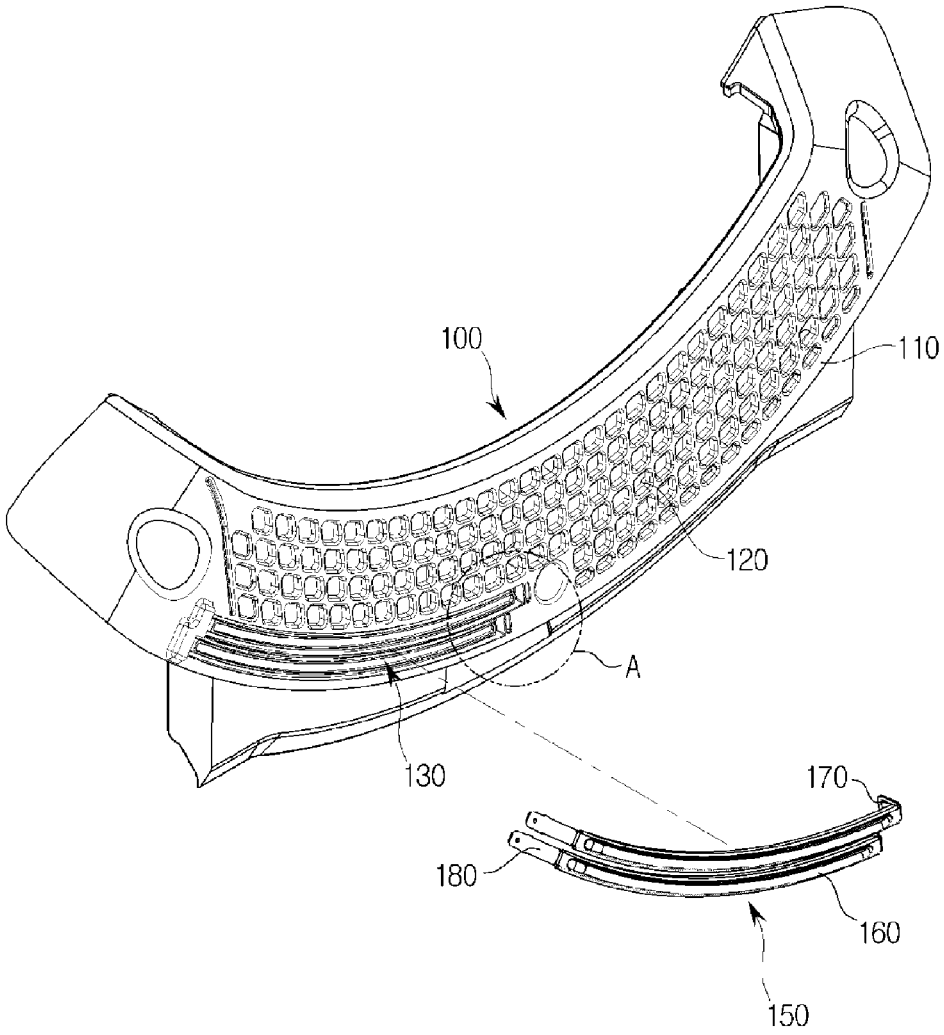
FIG. 4 is an exploded perspective view of the filter member and a humidity-sensing sensor unit according to an embodiment of the present disclosure.
Figure 5:
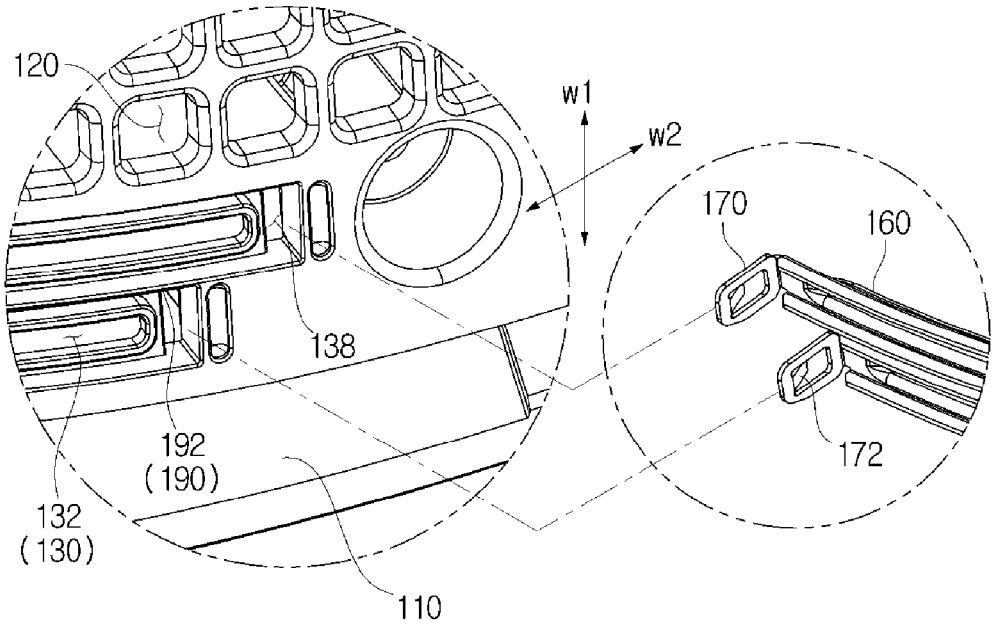
FIG. 5 is an enlarged view of portion A of FIG. 4.

FIG. 2 is a view illustrating a front side of the clothing dryer illustrated in FIG. 1, and FIG. 3 is a view illustrating a filter member according to an embodiment of the present disclosure, and FIG. 4 is an exploded perspective view of the filter member and a humidity-sensing sensor unit according to an embodiment of the present disclosure, and FIG. 5 is an enlarged view of portion A of FIG. 4.

The filter member 100 is provided to prevent introduction of foreign substances or the laundry into the front duct 24 when dry air that passes through an inside of the drying tub 30 passes through the wet laundry and is discharged. In the current embodiment, the filter member 100 is provided between the front duct 24, which communicates with the drying tub 30 and through which air passing through the inside of the drying tub 30 is discharged, and the drying tub 30 so as to filter foreign substances. However, embodiments of the present disclosure are not limited thereto.

The filter member 100 may include a filter member body 110, an air discharging portion 120, and a sensor mounting portion 130.

The filter member body 110 is disposed adjacent to the drying tub 30 and is provided to be disposed at a lower part of a front side of the drying tub 30 in the current embodiment. The air discharging portion 120 may be provided on the filter member body 110 so that air passing through the drying tub 30 can be discharged via the front duct 24.

The sensor mounting portion 130 may be provided on the filter member body 110 to be adjacent to the air discharging portion 120. However, the shape or arrangement of the sensor mounting portion 130 is not limited thereto. The sensor mounting portion 130 will be described below in detail.

The humidity-sensing sensor unit 150 is provided to sense a degree of drying of the laundry put in the drying tub 30. The arrangement and operating principle of the humidity-sensing sensor unit 150 are not limited thereto. In the current embodiment of the present disclosure, the humidity-sensing sensor unit 150 is provided to extend in a lengthwise direction and to be mounted on the filter member 100. At least one humidity-sensing sensor unit 150 may be provided.

The humidity-sensing sensor unit 150 may include a humidity-sensing sensing portion 160 and a fixed bending portion 170.

The humidity-sensing sensing portion 160 may be provided to be exposed to an inside of the drying tub 30. A plurality of humidity-sensing sensing portions 160 may be provided, and in the current embodiment of the present disclosure, a pair of humidity-sensing sensing portions 160 may be provided. The humidity-sensing sensing portion 160 senses a degree of drying of the laundry when the laundry rotating together with rotation of the drying tub 30 contacts the humidity-sensing sensing portion 160. In detail, when the wet laundry contacts the pair of humidity-sensing sensing portions 160, electricity is generated therebetween. The degree of drying of the laundry is determined by measuring a degree of electricity.

The plurality of humidity-sensing sensing portions 160 may be formed to extend along a circumferential direction so as to correspond to a rotation direction of the drying tub 30 and may be provided in parallel not to overlap each other.

Ends of the plurality of humidity-sensing sensing portions 160 may be provided not to overlap each other in a first direction w1 that is a vertical direction. That is, the ends of the plurality of humidity-sensing sensing portions 160 may be provided so that one end of one humidity-sensing sensing portion 160 and one end of another adjacent humidity-sensing sensing portion 160 may not be disposed in parallel in the vertical direction.

In other words, the ends of the plurality of humidity-sensing sensing portions 160 may be provided to be spaced apart from each other in a second direction w2 that is a horizontal direction so that the humidity-sensing sensing portion 160 disposed at a lower part of the humidity-sensing sensor unit 150 may not be affected by the humidity-sensing sensing portion 160 disposed at an upper part of the humidity-sensing sensor unit 150.

The fixed bending portion 170 is provided to be bent from one end of the humidity-sensing sensing portion 160 so that the humidity-sensing sensing portion 160 can be fixed to the fixed bending portion 170. A plurality of fixed bending portions 170 may be provided with the plurality of humidity-sensing sensing portions 160, and in the current embodiment of the present disclosure, a pair of fixed bending portions 170 are provided.

The pair of fixed bending portions 170 may be provided so that electricity can be generated between each fixed bending portion 170 and the humidity-sensing sensing portion 160 or so that each fixed bending portion 170 may be insulated from the humidity-sensing sensing portion 160.

Since the fixed bending portions 170 are provided at ends of the humidity-sensing sensor unit 150, humidity may be accumulated and may cause malfunction in the humidity-sensing sensor unit 150 or may reduce a life span of the humidity-sensing sensor unit 150. Thus, the fixed bending portions 170 may be disposed in a first space 140 that is an opened space in which ventilation may be performed.

A discharge opening 136 is provided in the first space 140 so that at least one side of the discharge opening 136 can be opened. In the current embodiment, the discharge opening 136 is opened in a downward direction and is provided so that water that may be generated due to accumulated humidity can be discharged through the discharge opening 136.

The plurality of fixed bending portions 170 may be provided to be spaced apart from each other in the second direction w2 that is the horizontal direction. Through this configuration, the fixed bending portion 170 disposed at a lower part of the humidity-sensing sensor unit 150 may not be affected by the fixed bending portion 170 disposed at an upper part of the humidity-sensing sensor unit 150.

The filter member 100 may include the sensor mounting portion 130 on which the humidity-sensing sensor unit 150 may be mounted.

The sensor mounting portion 130 may include first mounting portions 132 and second mounting portions 134.

The first mounting portions 132 are provided to correspond to the humidity-sensing sensing portions 160 so that the humidity-sensing sensing portions 160 can be mounted on each of the first mounting portions 132. That is, the first mounting portions 132 are provided to correspond to the shape of the humidity-sensing sensing portions 160 and to be concaver than the surface of the adjacent filter member 100 and are provided to correspond to the humidity-sensing sensing portions 160 formed in the lengthwise direction to be concave in the lengthwise direction.

The first mounting portions 132 may be formed to extend along the circumferential direction caused by the rotation direction of the drying tub 30 and may be provided in parallel not to overlap each other. Since a plurality of humidity-sensing sensor units 150 may be provided, a plurality of first mounting portions 132 may also be provided.

The second mounting portions 134 are provided to correspond to the fixed bending portions 170 so that the fixed bending portions 170 can be mounted on the second mounting portions 134. The second mounting portions 134 have the same configuration as that of the first space 140, and a description of the second mounting portions 134 is the same as that of the first space 140. Since the plurality of fixed bending portions 170 may be provided, a plurality of second mounting portions 134 may also be provided.

Each of the plurality of second mounting portions 134 may be provided to accommodate the plurality of fixed bending portions 170 and may be partitioned off by a fixed bending portion barrier wall 194 that will be described later. Also, the plurality of second mounting portions 134 may be disposed to correspond to the plurality of fixed bending portions 170 that are spaced apart from each other in the second direction w2 that is the horizontal direction and may be disposed in parallel in the second direction w2.

The humidity-sensing sensor unit 150 may further include terminal connection portions 180.

The terminal connection portions 180 are connected to terminals that are connected to a control unit, and the terminal connecting portions 180 are provided to electrically transmit a degree of drying of the laundry sensed by the humidity-sensing sensor unit 150 to the control unit. The shape of the terminal connection portions 180 is not limited thereto, and in the current embodiment, each of the terminal connection portions 180 has a shape in which each terminal connection portion 180 is bent from the humidity-sensing sensing portions 160 and extends.

Figure 6:
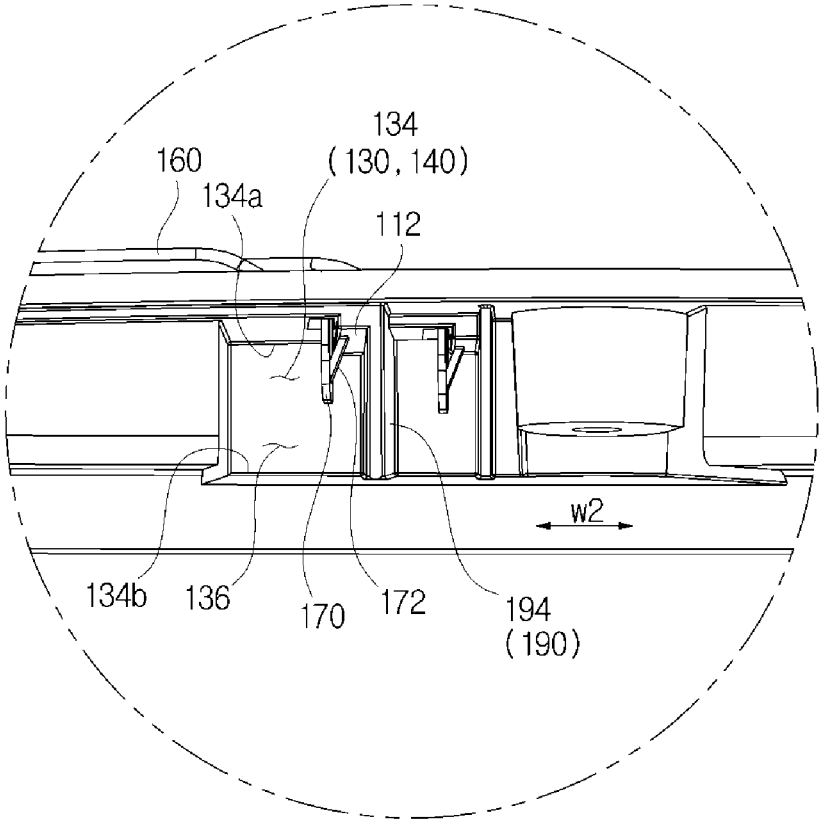
FIG. 6 is a view illustrating the humidity-sensing sensor unit according to an embodiment of the present disclosure.

FIG. 5 is an enlarged view of portion A of FIG. 4, and FIG. 6 is a view illustrating the humidity-sensing sensor unit according to an embodiment of the present disclosure.

A sensor barrier wall 190 is provided to partition the plurality of humidity-sensing sensor units 150 off. The plurality of humidity-sensing sensor units 150 are partitioned off so that malfunction of the clothing dryer 1*a* can be prevented from occurring due to lint with moisture or foreign substances generated between the plurality of humidity-sensing sensor units 150 and a more exact sensing operation can be performed.

The sensor barrier wall 190 may include a sensing portion barrier wall 192 and the fixed bending portion barrier wall 194.

The sensing portion barrier wall 192 is provided to partition the plurality of humidity-sensing sensing portions 160 off. The sensing portion barrier wall 192 may be provided between the plurality of first mounting portions 132.

The sensing portion barrier wall 192 is provided so that malfunction in humidity sensing can be prevented from occurring due to lint with moisture or foreign substances generated between the plurality of humidity-sensing sensing portions 160 mounted on the first mounting portions 132. The sensing portion barrier wall 192 is formed on the first mounting portions 132 along a lengthwise direction of the first mounting portions 132 and to be more protrusive than the first mounting portions 132. The shape of the sensing portion barrier wall 192 is not limited thereto, and a configuration in which the sensing portion barrier wall 192 may partition the plurality of humidity-sensing sensing portions 160 mounted on the first mounting portions 132 off, may be sufficient.

The fixed bending portion barrier wall 194 is provided to partition the plurality of fixed bending portions 170 off. The fixed bending portion barrier wall 194 may be provided between the plurality of second mounting portions 134.

The fixed bending portion barrier wall 194 is provided so that malfunction in humidity sensing can be prevented from occurring due to lint with moisture or foreign substances generated between the plurality of fixed bending portions 170 mounted on the second mounting portions 134. The fixed bending portion barrier wall 194 is provided to partition the plurality of fixed bending portions 170 on the second mounting portions 134.

The fixed bending portion barrier wall 194 may extend from a first surface 134*a* with an insertion hole 138 through which the fixed bending portions 170 are inserted into the second mounting portions 134, to lengths of the fixed bending portions 170 or more so as to partition the plurality of fixed bending portions 170 off. In the current embodiment, the fixed bending portion barrier wall 194 is formed to extend from the first surface 134*a* to a second surface 134*b* that faces the first surface 134*a*.

Referring to FIG. 5, the humidity-sensing sensing portions 160 are provided to be mounted on the first mounting portions 132, and the fixed bending portions 170 are provided to be inserted into the insertion hole 138 and to be mounted on the second mounting portions 134.

The fixed bending portions 170 may include hanging inclination surfaces 172.

The hanging inclination surfaces 172 are formed to be inclined in an opposite direction to a direction in which the fixed bending portions 170 are inserted into the second mounting portions 134 and are formed to be hung in hanging jaws 112 provided at the filter member 100.

Through this configuration, the fixed bending portions 170 can be prevented from easily escaping from the second mounting portions 134. That is, when the fixed bending portions 170 are mounted on the second mounting portions 134 through the insertion hole 138, the hanging inclination surfaces 172 are hung in the hanging jaws 112 and thus are provided to prevent the fixed bending portions 170 from easily escaping from the second mounting portions 134.

Figure 7:
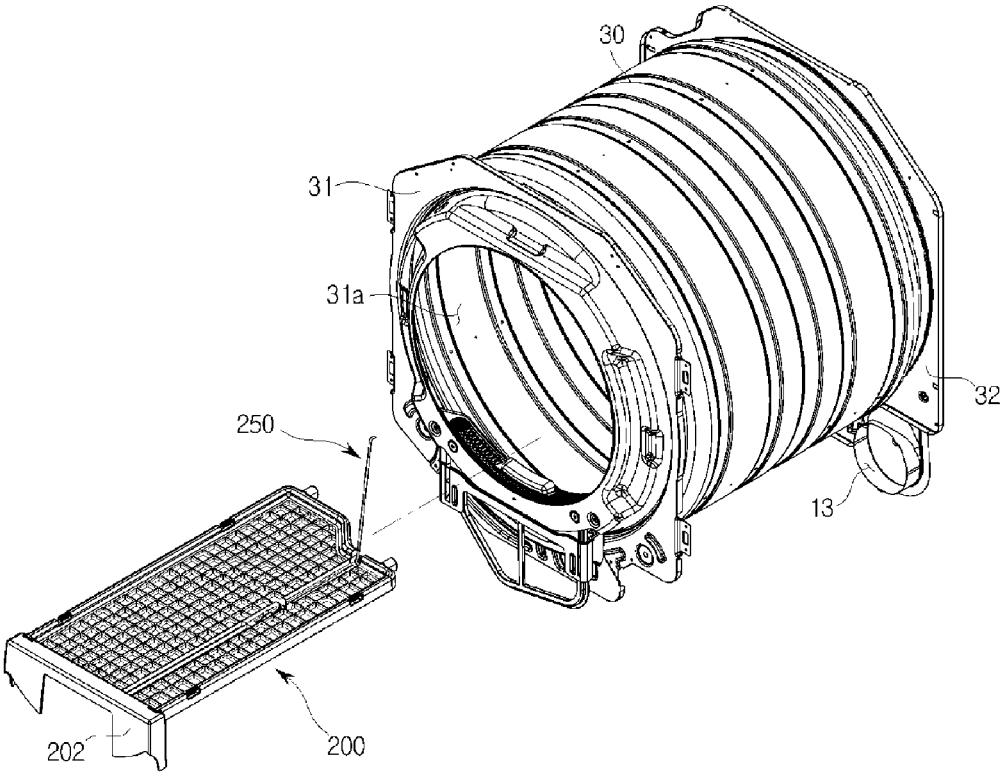
FIGS. 7 and 8 are views illustrating arrangement of a drying shelf according to other embodiments of the present disclosure.

FIG. 7 is a view illustrating arrangement of a drying shelf according to an embodiment of the present disclosure.

The drying tub 30 is provided to include the cylindrical portion 33 and the rear side portion 32. The cylindrical portion 33 has a cylindrical shape in which front and rear sides of the cylindrical portion 33 are opened. The front side portion 31 is coupled to the front side of the cylindrical portion 33, and the rear side portion 32 is installed at the rear side of the cylindrical portion 33.

The drying tub 30 may be provided to be rotated. The cylindrical portion 33 and the rear side portion 32 may be provided to be rotatable together. However, in the current embodiment of the present disclosure, the cylindrical portion 33 may be provided to be rotatable, and the rear side portion 32 may be provided in a fixed state.

A plurality of lifters 33*a* may be disposed in the cylindrical portion 33 along a circumferential direction of the cylindrical portion 33. The plurality of lifters 33*a* lift or drop the laundry so that the laundry can be effectively dried.

A drying shelf 200 is separably installed in the drying tub 30. A front end of the drying shelf 200 may be supported by the filter member 100, and a rear end of the drying shelf 200 may be supported by the rear side portion 32 that is the rear side of the drying tub 30. Since both the front and rear ends of the drying shelf 200 are supported, even when heavy laundry is put on the drying shelf 200, the drying shelf 200 can be maintained in a state in which the laundry is stably supported.

Figure 8:
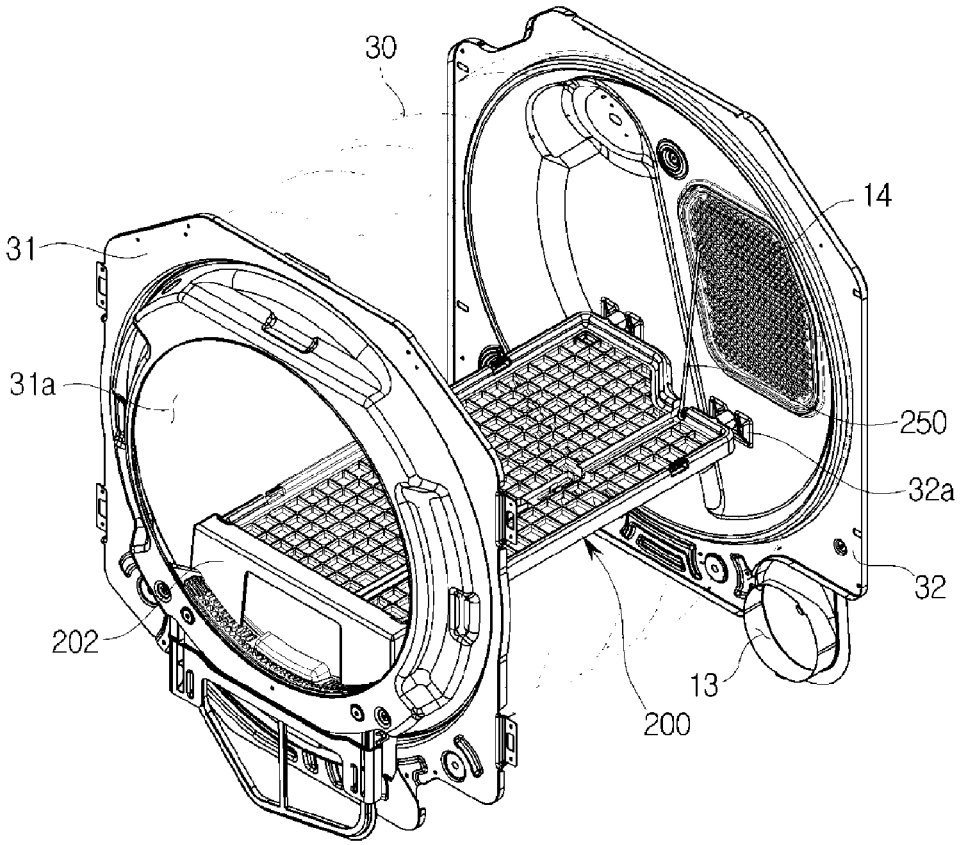
Figure 9:
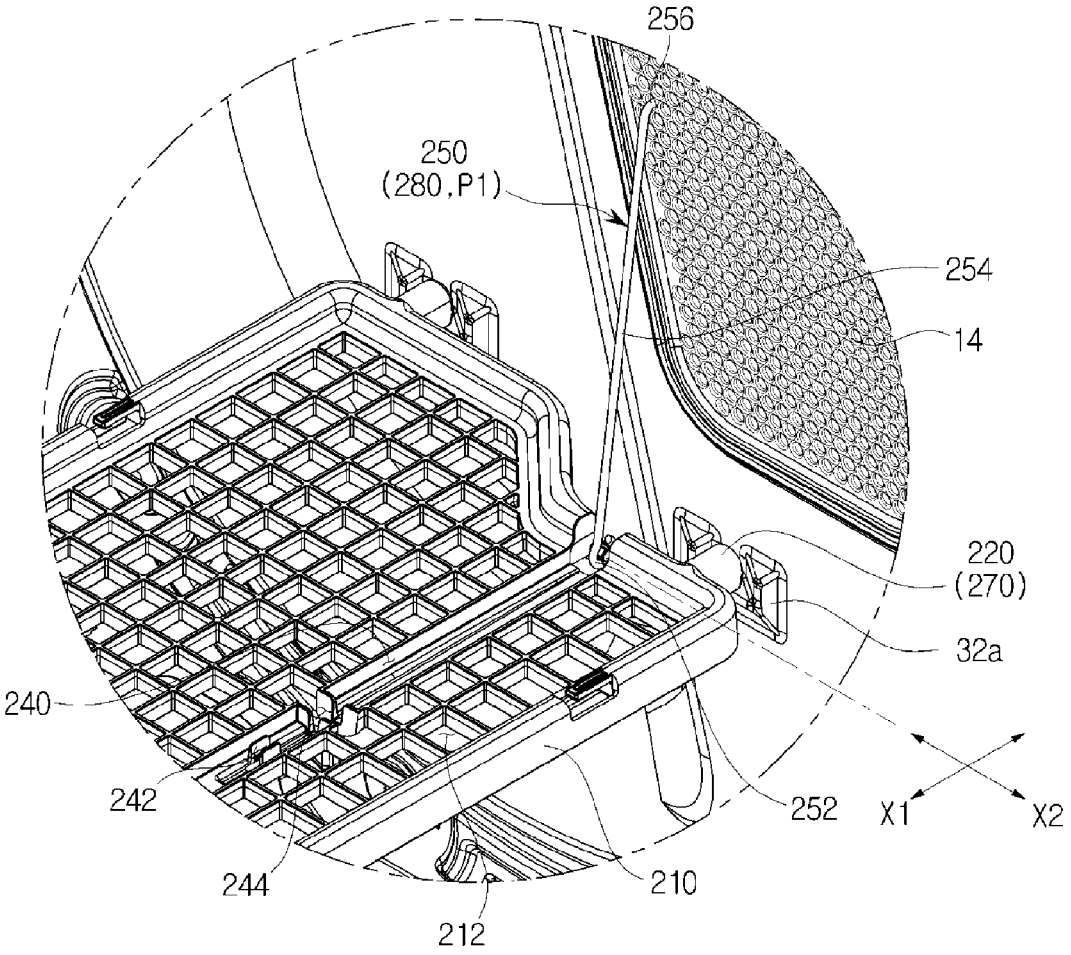
FIG. 9 is a view illustrating a supporting member at a first position according to an embodiment of the present disclosure.
Figure 10:
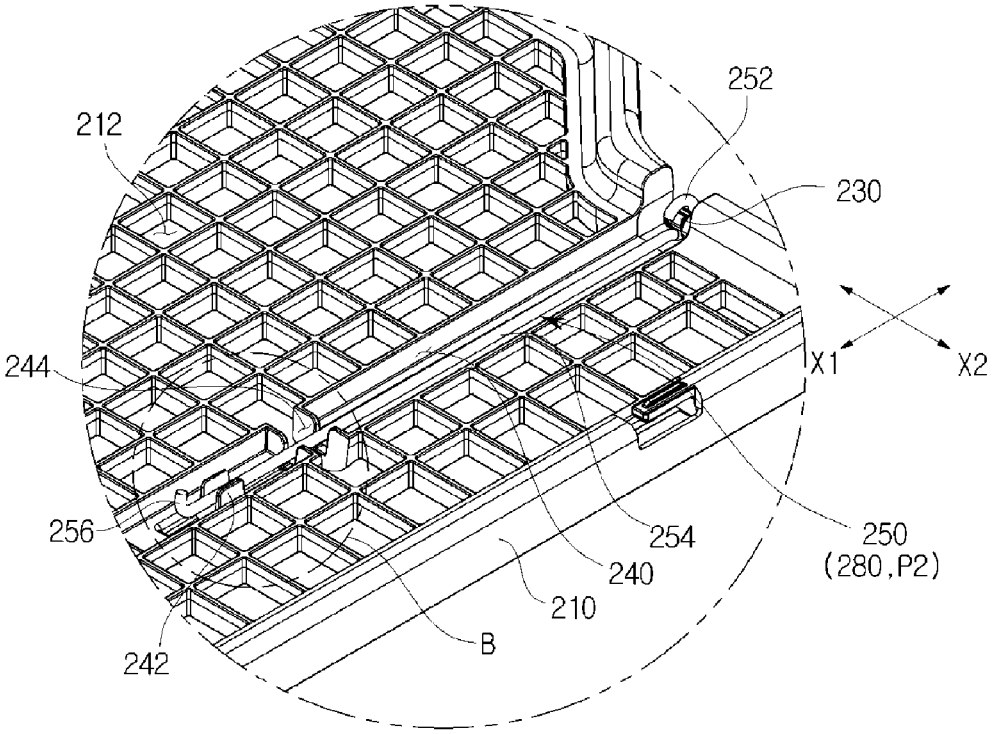
FIG. 10 is a view illustrating a supporting member at a second position according to an embodiment of the present disclosure.
Figure 11:
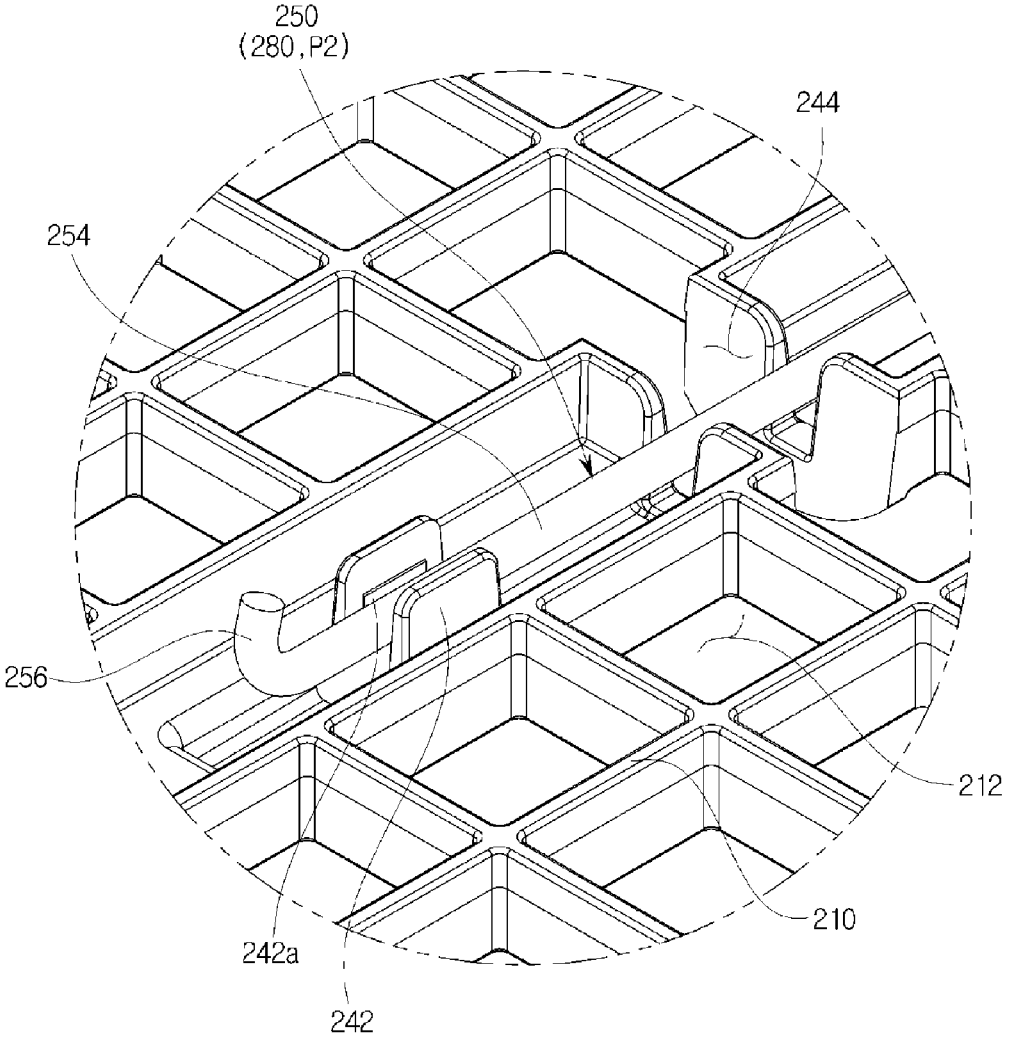
FIG. 11 is an enlarged view of portion B of FIG. 10.
Figure 12:
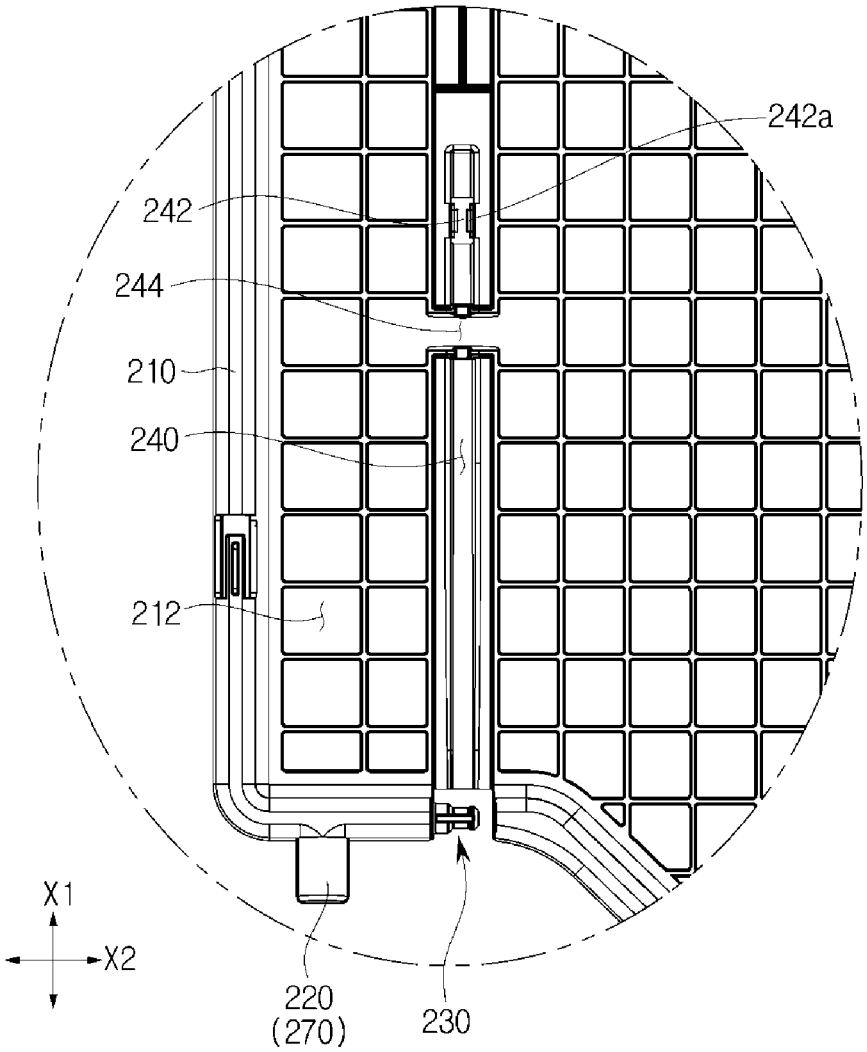
FIG. 12 is a partial enlarged view of a drying shelf according to an embodiment of the present disclosure.

FIG. 8 is a view illustrating arrangement of a drying shelf according to an embodiment of the present disclosure, and FIG. 9 is a view illustrating a supporting member at a first position according to an embodiment of the present disclosure, and FIG. 10 is a view illustrating a supporting member at a second position according to an embodiment of the present disclosure, and FIG. 11 is an enlarged view of portion B of FIG. 10, and FIG. 12 is a partial enlarged view of a drying shelf according to an embodiment of the present disclosure.

The front end of the drying shelf 200 is supported by the filter member 100, and the rear end of the drying shelf 200 is supported by the rear side portion 32 that is the rear side of the drying tub 30. Since the filter member 100 has an upper part that is concave due to the shape of the laundry ports 1*b* and 31*a*, a mounting rib 202 that corresponds to the shape of an upper portion of the filter member 100 may be provided at the front end of the drying shelf 200 so as to be mounted on the upper portion of the filter member 100.

The drying shelf 200 may include a base 210, supporting protrusions 220, and a hanging member 230.

The base 210 may be provided so that an object to be dried can be put on the base 210. The base 210 may be formed to have a plurality of through holes 212 through which water discharged from the object to be dried can be discharged. Unlike the object to be dried disposed in the cylindrical portion 33, the object being lifted or dropped and dried by rotation, the object to be dried disposed on the drying shelf 200 is dried in a state in which the object to be dried is put on the base 210. Thus, the position of the drying shelf 200 is required to be maintained. To this end, the base 210 may be provided so as to maintain level at an inside of the drying tub 30. The shape of the base 210 is not particularly limited, and the base 210 may be provided to correspond to the shape of the inside of the drying tub 30.

The supporting protrusions 220 protrude from the base 210 and are provided to support the rear end of the drying shelf 200. In detail, the supporting protrusions 220 are provided to protrude from the base 210 toward the rear side portion 32 of the drying tub 30. At least one supporting protrusion 220 may be provided, and in the current embodiment of the present disclosure, a pair of supporting protrusions 220 are provided to support both sides of the rear end of the drying shelf 200.

A protrusion mounting portion 32*a* that is formed convexly toward an inside of the drying tub 30 may be provided on the rear side portion 32 so that the supporting protrusions 220 can be mounted on the protrusion mounting portion 32*a*. At least one protrusion mounting portion 32*a* may be provided to correspond to the supporting protrusions 220, and in the current embodiment of the present disclosure, a pair of protrusion mounting portions 32*a* may be provided.

The hanging member 230 is provided so that a supporting member 250 that will be described later can be pivoted around the drying shelf 200. The shape of the hanging member 230 is not particularly limited, and a configuration provided so that a pivoting portion 252 of the supporting member 250 that will be described later may rotate, is sufficient.

When a lengthwise direction of the drying shelf 200 is a first direction X1, the hanging member 230 may be provided to protrude from the base 210 in a second direction X2 that is perpendicular to the first direction X1. Also, the hanging member 230 may be provided to be spaced apart from the base 210 by a predetermined gap in an extension line in the second direction X2 of the hanging member 230 so that the supporting member 250 can escape from the hanging member 230.

The supporting member 250 supports the drying shelf 200 so that the drying shelf 200 mounted in the drying tub 30 does not escape from the drying tub 30. The supporting member 250 is provided to be pivoted around the drying shelf 200 and supports the drying shelf 200 or is provided to be mounted on the drying shelf 200.

In detail, the supporting member 250 is provided to be movable at a first position P1 in which one side of the drying shelf 200 is supported in the cabinet 1 and at a second position P2 in which the supporting member 250 is mounted on the drying shelf 200.

When the supporting member 250 is provided to be pivoted around the drying shelf 200 and the drying shelf 200 is disposed in the drying tub 30, the supporting member 250 is pivoted at the first position P1 so as to support the drying shelf 200, and when the drying shelf 200 is kept without being used, the supporting member 250 is pivoted at the second position P2 so as to be mounted on the drying shelf 200.

The supporting member 250 may include the pivoting portion 252 and a support 254.

The pivoting portion 252 causes the supporting member 250 to be provided at one side of the drying shelf 200 at the first position P1 and the second position P2. The pivoting portion 252 is provided to be pivotably hung in the hanging member 230. In the current embodiment, the pivoting portion 252 has a ring shape. The supporting member 250 may be coupled to the drying shelf 200 using a hinge through the pivoting portion 252 so as to be pivoted at the first position P1 and the second position P2. The supporting member 250 is provided to be pivoted around the second direction X2 that is a central axis through the pivoting portion 252.

The support 254 is provided to extend from the pivoting portion 252 and to support the drying shelf 200. In detail, the support 254 extends from the pivoting portion 252 and is supported by the rear side portion 32 of the drying tub 30 so as to support the drying shelf 200. The support 254 supports the drying shelf 200 and the object to be dried put on the drying shelf 200 so that the drying shelf 200 does not escape from the drying tub 30. However, since the drying shelf 200 may escape from the drying tub 30 in vertical and horizontal directions, the support 254 is formed to have a strong rod shape so as to maintain the position of the drying shelf 200.

The supporting member 250 may further include a fixed hanging portion 256.

The fixed hanging portion 256 is provided at an end of the support 254 so as to be fixed to the rear side of the drying tub 30. In detail, the fixed hanging portion 256 is provided to be bent from the end of the support 254 and to extend.

The fixed hanging portion 256 is provided to be hung in the rear side of the drying tub 30 and supports the drying shelf 200 so that the drying shelf 200 does not escape from the drying tub 30 due to rotation or vibration of the drying tub 30. A configuration corresponding to the fixed hanging portion 256 is not limited thereto, and in the current embodiment of the present disclosure, the fixed hanging portion 256 is provided to be hung in an outlet through which dry air is introduced into the inside of the drying tub 30.

The drying shelf 200 may include mounting grooves 240 and fixing protrusions 242.

When the supporting member 250 is disposed at the second position P2, i.e., when the supporting member 250 is mounted on the drying shelf 200, the mounting grooves 240 are provided so that the supporting member 250 can be disposed on the drying shelf 200. The mounting grooves 240 may be formed concaver than the surface of the adjacent drying shelf 200. The mounting grooves 240 are formed lengthwise to correspond to the length of the supporting member 250, and when the supporting member 250 is disposed at the second position P2, the mounting grooves 240 may be formed concavely so that the supporting member 250 does not protrude outwards.

The fixing protrusions 242 are provided to fix the supporting member 250 mounted on the mounting grooves 240. A pair of fixing protrusions 242 are provided so as to support both sides of the supporting member 250. In detail, the pair of fixing protrusions 242 are provided to have elasticity and are spaced from each other when the supporting member 250 is inserted into the mounting grooves 240, and the pair of fixing protrusions 242 are provided to be returned to their original position when the supporting member 250 escapes from the mounting grooves 240. Each of the pair of fixing protrusions 242 includes an escape prevention protrusion 242*a* that protrudes toward an inside of the fixing protrusion 242. The escape prevention protrusion 242*a* prevents the supporting member 250 fixed by the fixing protrusions 242 from easily escaping from the mounting grooves 240.

Separation grooves 244 may be provided in the mounting grooves 240 that are formed in a lengthwise direction of the supporting member 250 so that the supporting member 250 can be mounted on the mounting grooves 240, in a direction perpendicular to the lengthwise direction of the supporting member 250. The separation grooves 244 are provided to have larger widths than those of the adjacent mounting grooves 240 so that, when a user detaches the supporting member 250 from the mounting grooves 240, the user can grasp the supporting member 250 by inserting his/her finger into the mounting grooves 240.

Figure 13:
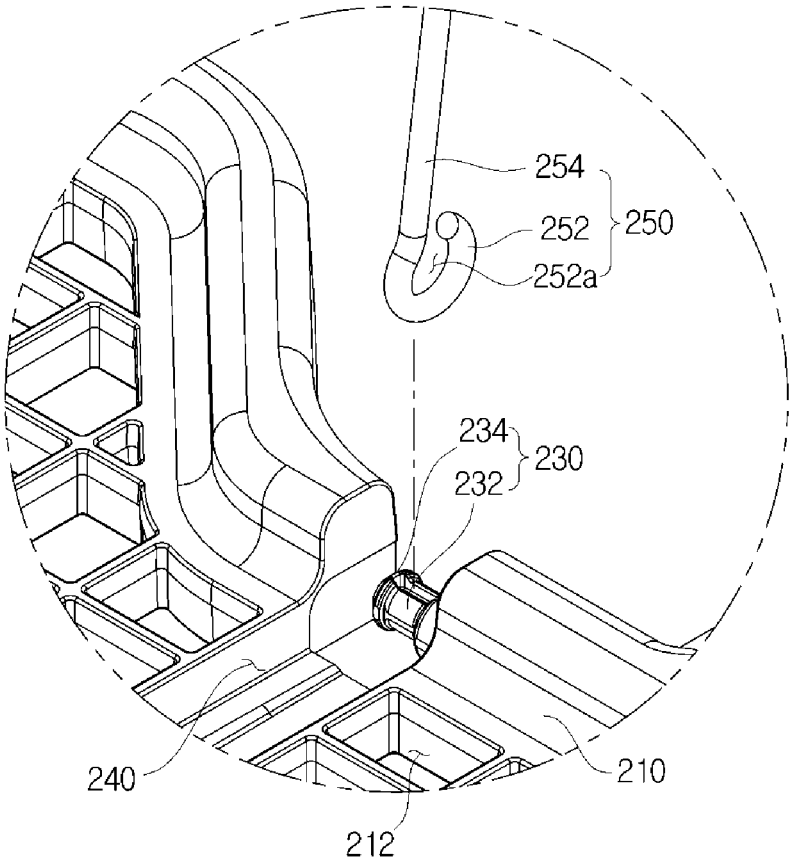
FIG. 13 is a view illustrating coupling of the drying shelf and the supporting member according to an embodiment of the present disclosure.
Figure 14:
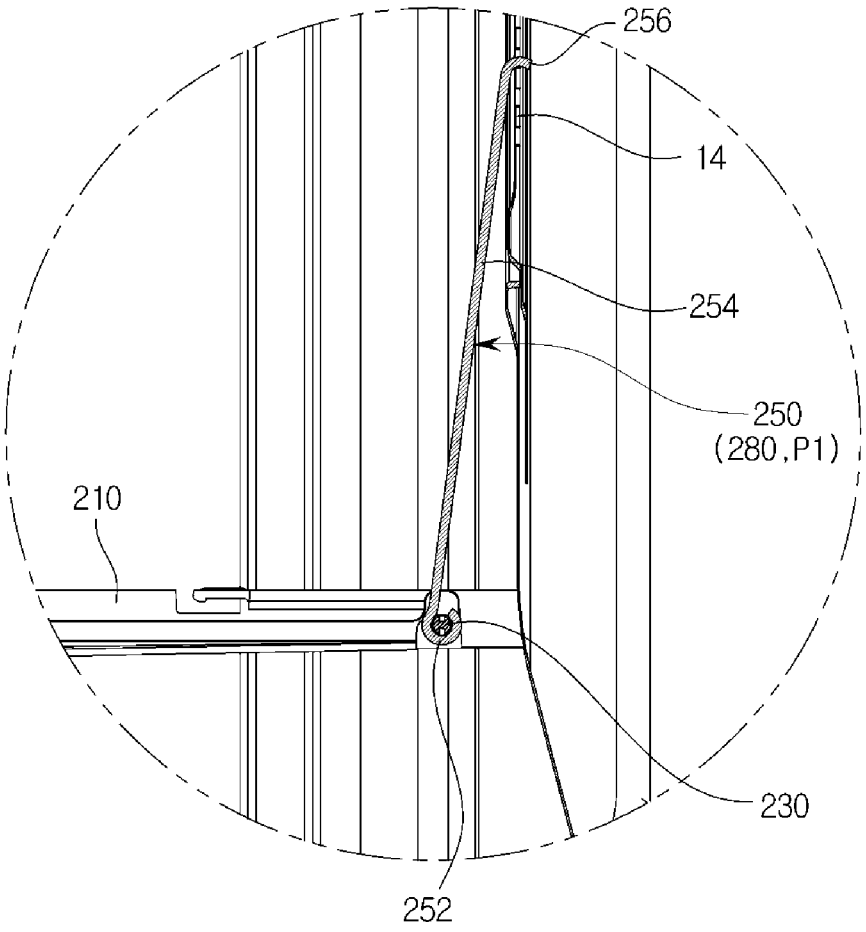
FIG. 14 is a cross-sectional view illustrating coupling of the drying shelf and the supporting member according to an embodiment of the present disclosure.

FIG. 13 is a view illustrating coupling of the drying shelf and the supporting member according to an embodiment of the present disclosure, and FIG. 14 is a cross-sectional view illustrating coupling of the drying shelf and the supporting member according to an embodiment of the present disclosure.

An insertion hole 252*a* is provided in the pivoting portion 252 so that the supporting member 250 can be attached to the hanging member 230 through the insertion hole 252*a*.

A pivoting mounting portion 232 is provided at a middle end of the hanging member 230 so as to be concaver than the surface of the adjacent hanging member 230 so that the pivoting portion 252 can be mounted on the pivoting mounting portion 232. Also, a pivoting insertion portion 234, of which a diameter is larger than that of the pivoting mounting portion 232, may be provided at an end of the hanging member 230 so that the pivoting portion 252 does not easily escape from the hanging member 230.

When the supporting member 250 is disposed at the first position P1, the supporting member 250 may be provided to form an obtuse angle with the base 210. As the supporting member 250 and the base 210 are disposed at obtuse angles, even when the supporting protrusions 220 escape from mounting protrusions, a center of gravity of the drying shelf 200 and a center of gravity of the object to be dried put on the drying shelf 200 may be placed behind the base 210 so that the drying shelf 200 can be stably supported.

Hereinafter, a clothing dryer according to an embodiment of the present disclosure will be described in another aspect.

The clothing dryer includes a cabinet 1, a drying tub 30 disposed in the cabinet 1, a drying shelf 200 disposed in the drying tub 30, and a main supporting member 270 and an auxiliary supporting member 280 that support the drying shelf 200.

A description of redundant configurations will be omitted.

The main supporting member 270 and the auxiliary supporting member 280 have the same configurations as those of the supporting protrusions 220 and the supporting member 250. At least one main supporting member 270 is provided to protrude from a rear side of the base 210 and to be supported by a rear side portion 32 of the drying tub 30. One end of the auxiliary supporting member 280 is provided to be pivoted around the drying shelf 200, and the other end of the auxiliary supporting member 280 is provided to be supported by the rear side portion 32.

As described above, in a clothing dryer according to the present disclosure, a supporting structure of a drying shelf is improved so that supporting force of the drying shelf can be improved and the drying shelf does not escape from a drying tub even when an external shock or excessive vibration is applied to the drying shelf.

In addition, in the clothing dryer according to the present disclosure, the supporting structure is improved to improve supporting force of the drying shelf so that the drying shelf does not escape from the drying tub even when the external shock or excessive vibration is applied to the drying shelf. Furthermore, supporting force of the drying shelf is improved so that drying efficiency can be improved.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A clothing dryer comprising:

a cabinet;

a drying tub that is disposed in the cabinet and accommodates laundry;

a drying shelf disposed in the drying tub; and a supporting member disposed to support the drying shelf and provided to be movable at a first position in which one side of the drying shelf is supported in the cabinet and at a second position in which the supporting member is mounted on the drying shelf, wherein the supporting member comprises a pivoting portion pivotally connected to the drying shelf, a support part extending from the pivoting portion, and a fixed hanging portion formed at an end of the support part, the fixed hanging portion being configured to be fixed to a rear side of the drying tub.

2. The clothing dryer of claim 1, wherein the drying shelf comprises:

a base on which an object to be dried is mounted; and a hanging member which is provided at one side of the base and to which the pivoting portion is coupled using a hinge.

3. The clothing dryer of claim 2, wherein, when a lengthwise direction of the base is a first direction, the hanging member protrudes from the base in a second direction that is perpendicular to the first direction, and the supporting member is pivoted around the second direction that is a central axis.

4. The clothing dryer of claim 1, wherein the drying shelf comprises:

a mounting groove on which the supporting member at the second position is mounted; and fixing protrusions provided on the mounting groove to fix the supporting member.

5. The clothing dryer of claim 4, wherein the drying shelf further comprises a separation groove that is disposed in the mounting groove so as to pivot the supporting member at the second position and is formed to have a larger width than the mounting groove.

6. The clothing dryer of claim 1, wherein the drying tub comprises:

a cylindrical portion that is rotatably provided; and a rear side portion having an outlet through which dry air is introduced into the drying tub and disposed at a rear side of the cylindrical portion, and the fixed hanging portion is provided to be hung in the outlet.

7. The clothing dryer of claim 1, wherein the drying shelf comprises a base on which an object to be dried is mounted, and when the supporting member is at the first position, the support part is provided to form an obtuse angle with the base.

8. The clothing dryer of claim 7, wherein the drying tub comprises:

a cylindrical portion that is rotatably provided; and a rear side portion disposed at a rear side of the cylindrical portion, and the drying shelf comprises a pair of supporting protrusions that protrude from the base so as to be supported by the rear side portion.

9. The clothing dryer of claim 8, wherein the pivoting portion is disposed between the pair of supporting protrusions.

10. A clothing dryer comprising:

a cabinet;

a drying tub that is disposed in the cabinet and accommodates laundry;

a drying shelf disposed in the drying tub; and a supporting member comprising a pivoting portion that is pivotably provided at one side of the drying shelf; and a support that extends from the pivoting portion and is supported by a rear side of the drying tub, wherein the supporting member is disposed to support the drying shelf and provided to be pivotable at a first position in which the drying shelf is supported by the rear side of the drying tub and at a second position in which the supporting member is mounted on the drying shelf.

11. The clothing dryer of claim 10, wherein the drying shelf comprises:

a base on which an object to be dried is mounted; and a hanging member which is provided at one side of the base and to which the pivoting portion is coupled using a hinge, and the pivoting portion is coupled to the hanging member using a hinge so that the supporting member is capable of being pivoted.

12. The clothing dryer of claim 11, wherein the hanging member protrudes from the base in a direction of a first axis that is a horizontal direction, and the supporting member is pivoted around the first axis.

13. The clothing dryer of claim 10, wherein the supporting member is provided so that the first position and the second position constitute an obtuse angle.

14. The clothing dryer of claim 11, wherein the drying shelf further comprises supporting protrusions that protrude from the base toward the rear side of the drying tub so as to be supported by the rear side of the drying tub.

15. The clothing dryer of claim 10, wherein the supporting member further comprises a fixed hanging portion that is bent from an end of the support and extends so as to be fixed to the rear side of the drying tub at the first position.

16. The clothing dryer of claim 10, wherein the drying shelf further comprises:

a mounting groove formed concavely to correspond to a lengthwise direction of the supporting member so that the supporting member is capable of being mounted on the mounting grooves; and fixing protrusions that are provided on the mounting groove to fix sides of the support.

17. The clothing dryer of claim 16, wherein the fixing protrusions comprise a pair of fixing protrusions that support both sides of the supporting member that is at the second position.

* * * * *